US009976374B2

(12) United States Patent
Araujo et al.

(10) Patent No.: US 9,976,374 B2
(45) Date of Patent: May 22, 2018

(54) SIDE PACKER ASSEMBLY WITH SUPPORT MEMBER FOR RAM BLOWOUT PREVENTER

(71) Applicant: Cameron International Corporation, Houston, TX (US)

(72) Inventors: Raul Araujo, Cypress, TX (US); Jeffrey Lambert, Tomball, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 203 days.

(21) Appl. No.: 14/947,805

(22) Filed: Nov. 20, 2015

(65) Prior Publication Data

US 2017/0145772 A1 May 25, 2017

(51) Int. Cl.
*E21B 33/06* (2006.01)
*E21B 29/00* (2006.01)

(52) U.S. Cl.
CPC ..... *E21B 33/063* (2013.01); *E21B 29/00* (2013.01)

(58) Field of Classification Search
CPC ..... E21B 33/063; E21B 29/00
USPC ..... 251/1.1–1.3; 166/55, 361; 277/325
See application file for complete search history.

(56) References Cited

U.S. PATENT DOCUMENTS 2,919,111 A * 12/1959 Nicolson ..... E21B 29/08 166/361
3,561,526 A * 2/1971 Williams, Jr. ..... E21B 29/08 251/1.3
3,736,982 A * 6/1973 Vujasinovic ..... E21B 33/063 166/55
3,946,806 A * 3/1976 Meynier, III ..... E21B 33/063 166/55
4,265,424 A * 5/1981 Jones ..... E21B 33/062 251/1.3
4,347,898 A * 9/1982 Jones ..... E21B 29/08 251/1.3
5,005,802 A * 4/1991 McWhorter ..... E21B 33/062 251/1.3
5,013,005 A * 5/1991 Nance ..... E21B 33/062 251/1.3
5,515,916 A * 5/1996 Haley ..... E21B 33/063 166/55
6,089,526 A 7/2000 Olson
2006/0113501 A1 6/2006 Isaacks et al.
(Continued)

FOREIGN PATENT DOCUMENTS

WO 2006014895 2/2006

OTHER PUBLICATIONS

International Search Report and Written Opinion of PCT Application No. PCT/US2016/062097 dated Feb. 27, 2017: pp. 1-15.

*Primary Examiner* — John Bastianelli
(74) *Attorney, Agent, or Firm* — Helene Raybaud

(57) ABSTRACT

A blowout preventer ("BOP") includes a housing comprising a vertical bore extending through the housing and ram cavities intersecting the bore and a pair of opposing ram assemblies, with each ram assembly movably positionable within a ram cavity and comprising a side packer assembly. The side packer assembly comprises an upper plate, a lower plate, an elastomeric body positioned between the upper plate and the lower plate and comprising elastomeric material, and a support member positioned between the upper plate and the lower plate and configured to confine movement of the elastomeric body when sealing.

14 Claims, 2 Drawing Sheets

(56) References Cited

U.S. PATENT DOCUMENTS

| | | | |
|---|---|---|---|
| 2013/0062540 | A1 | 3/2013 | Jurena |
| 2015/0198003 | A1 | 7/2015 | Schaeper |

* cited by examiner

SIDE PACKER ASSEMBLY WITH SUPPORT MEMBER FOR RAM BLOWOUT PREVENTER

BACKGROUND

This section is intended to provide background information to facilitate a better understanding of the various aspects of the described embodiments. Accordingly, it should be understood that these statements are to be read in this light and not as admissions of prior art.

Blowout preventers (BOPS) are used extensively throughout the oil and gas industry. Typical BOPs are used as a large specialized valve or similar mechanical device that seal, control, and monitor oil and gas wells. The two categories of BOPs that are most prevalent are ram BOPs and annular BOPs. Blowout preventer stacks frequently utilize both types of BOPs, typically with at least one annular BOP stacked above several ram BOPs. The ram assemblies (i.e., rams) in ram BOPs allow for shearing drill pipe in the case of shear ram assemblies, sealing off around drill pipe in the case of pipe ram assemblies or variable bore ram assemblies, or sealing off the bore in the case of blind ram assemblies. Typically, a BOP stack may be secured to a wellhead and may provide a safe means for sealing the well in the event of a system failure.

A typical ram BOP includes a main body or housing with a vertical bore. Ram bonnet assemblies may be bolted to opposing sides of the main body using a number of high tensile fasteners, such as bolts or studs. These fasteners are required to hold the bonnet in position to enable the sealing arrangements to work effectively. One or more elastomeric sealing elements may then be used to form a seal within the main body and against the ram assemblies. There are several configurations, but essentially they are all directed to preventing a leakage bypass between the mating faces of the ram assembly and the main body. Each bonnet assembly includes a piston that is laterally movable within a ram cavity of the bonnet assembly by pressurized hydraulic fluid acting on one side of the piston. The opposite side of each piston has a connecting rod attached thereto that in turn has a ram assembly mounted thereon.

The ram assemblies are designed to move laterally toward the vertical bore of the BOP to shear or seal off on any object located therein. For a shear ram BOP, the shear ram assemblies are used to shear or cut any object located in the vertical bore of the blowout preventer. Pipe ram assemblies and variable bore ram assemblies utilize seals that close in on and seal off on a tubular within the vertical bore of the BOP, such as a section of drill pipe used during drilling operations. Blind ram assemblies also utilize seals, in which the ram assemblies close in and across the bore of the BOP when no object is present to seal across the bore.

The opposing ram assemblies may experience some axial separation when in use, particularly for shear ram assemblies when shearing a larger object (e.g., a tool joint) or wireline. For example, axial separation may result from shear forces encountered when shearing the object, leaving a vertical gap between the opposing shear blades. Further, seals, such as side packer assemblies, located on ram assemblies may also create an axial force to push the ram assemblies away from each other when sealing within the blowout preventer. Accordingly, a packer assembly for enabling ram assemblies to more efficiently seal or shear in a BOP bore may be desirable.

DESCRIPTION OF THE DRAWINGS

For a detailed description of the embodiments of the invention, reference will now be made to the accompanying drawings in which.

DETAILED DESCRIPTION

Figure 1A:
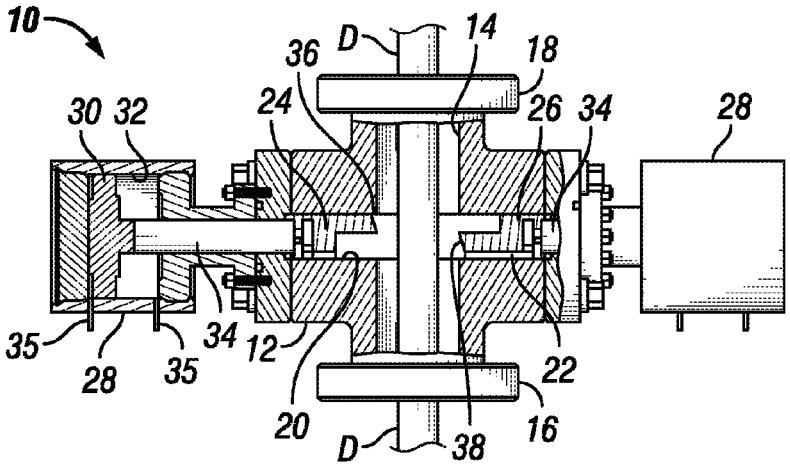
FIGS. 1A-1C depicts multiple cross-sectional views of a blowout preventer for shearing a tubular, according to one or more embodiments.
Figure 1B:
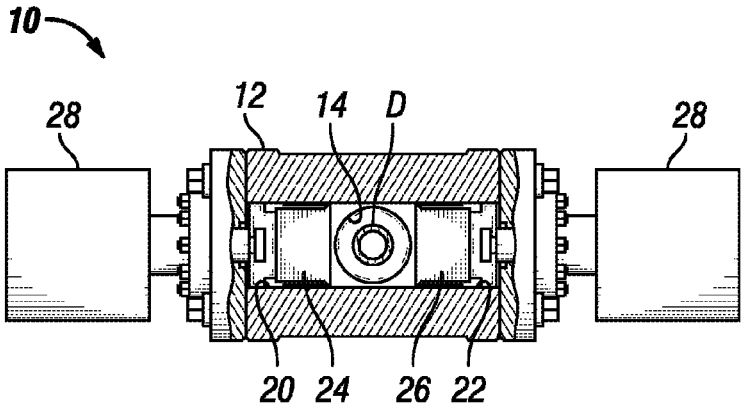
Figure 1C:
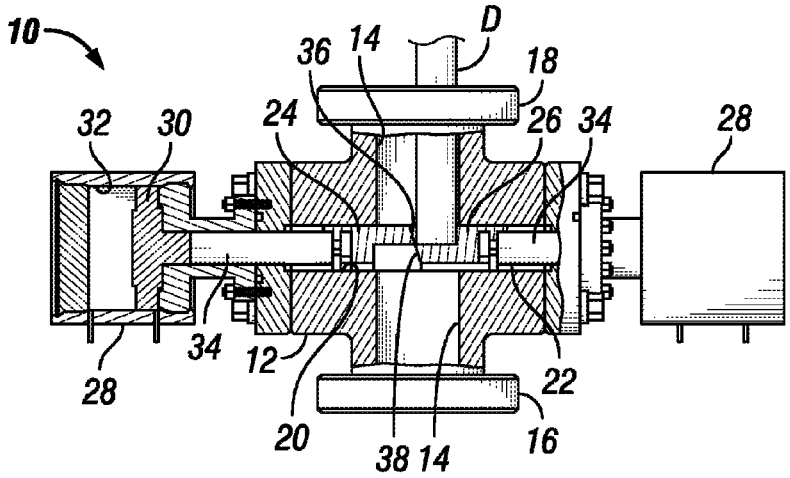

Referring now to FIGS. 1A-1C, multiple views of a blowout preventer ("BOP") 10 for shearing a tubular D in accordance with one or more embodiments of the present disclosure are shown. The BOP 10, which may be referred to as a ram BOP or shear ram BOP, includes a body or housing 12 with a vertical bore 14 formed and/or extending through the housing 12. As shown, the housing 12 includes a lower flange 16 and/or an upper flange 18 to facilitate connecting the BOP 10 to other BOPs or other components, such as a wellhead connector on the lower flange 16 or to a lower marine riser package on the upper flange 18. Ram cavities 20 and 22 are formed within the housing 12 of the BOP 10, with the cavities 20 and 22 intersecting and extending outwardly from the bore 14 on opposite sides of the BOP bore 14.

The BOP 10 includes one or more rams or ram assemblies, such as a first ram assembly 24 and a second ram assembly 26. The first ram assembly 24 may be positioned and movable within the first cavity 20 and a second ram assembly 26 positioned and movable within the second cavity 22. The first ram assembly 24 and the second ram assembly 26 are positioned to oppose each other (e.g., on opposite sides of the bore 14) and are movable towards and away from the tubular D. Actuators 28 are provided to move the first ram assembly 24 and the second ram assembly 26 into the BOP bore 14 to shear the portion of the tubular D extending through the BOP bore 14.

In this embodiment, a hydraulic actuator is shown, though any type of actuator (e.g., pneumatic, electrical, mechanical) may be used in accordance with the present disclosure. The actuators 28 include a piston 30 positioned within a cylinder 32 and a rod 34 connecting the piston 30 to each respective ram assembly 24 and 26. Further, pressurized fluid is introduced and fluidly communicated on opposite sides of the piston 30 through ports 35, thereby enabling the actuators 28 to move the ram assemblies 24 and 26 in response to fluid pressure.

A first (e.g., upper) blade 36 is included with or connected to the first ram assembly 24, and a second (e.g., lower) blade 38 is included with or connected to the second ram assembly 26. The first and second blades 36 and 38 are formed and positioned such that a cutting edge of the second blade 38 passes below a cutting edge of the first blade 36 in shearing of a section of a tubular D. The shearing action of first and second blades 36 and 38 shear the tubular D. The lower portion of the tubular D may then drop into the well bore (not shown) below BOP 10, or the lower portion of tubular D may be hung off a lower set of ram assemblies (not shown).

Accordingly, disclosed herein are a BOP apparatus and/or a side packer assembly for a BOP apparatus. As shown above, the BOP may be a shear ram BOP for shearing an object located within the BOP. The BOP may also be a pipe ram BOP or a variable bore ram BOP for sealing about an object located within the BOP, or may be a blind ram BOP for sealing across the bore of the BOP.

An object may be positioned within the bore extending through the BOP, in which the BOP is actuated to move one or more ram assemblies to engage and shear or seal against the object (if present), or seal against each other to form a seal across the bore. Such an object may have different shapes, sizes, thicknesses, and other dimensions and properties. For example, an object may include a drill pipe joint, a casing joint, a tool joint, or a wireline. To aid the ram assemblies when shearing or sealing within a BOP, the present disclosure provides a side packer assembly that confines movement of the elastomeric body (i.e., elastomeric sealing element) to a predetermined direction to facilitate engagement between the ram assemblies.

Figure 2:
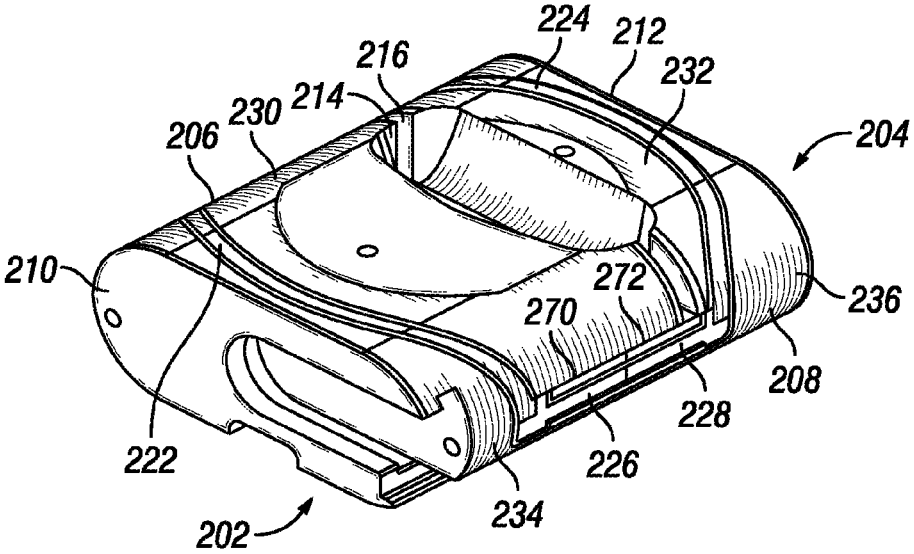
FIG. 2 depicts an above perspective view of opposing shear ram assemblies for a shear ram BOP, according to one or more embodiments.

Referring now to FIG. 2, an above perspective view of opposing shear ram assemblies 202 and 204 for a shear ram BOP in accordance with one or more embodiments of the present disclosure is shown. The shear ram assemblies 202 and 204 may be similar to the ram assemblies 24 and 26 illustrated in FIGS. 1A-1C, in which the shear ram assembly 202 may be the upper ram assembly and the shear ram assembly 204 may be the lower ram assembly. The shear ram assemblies 202 and 204 each include a ram body 206 and 208 that are defined by a ram back 210 and 212 and a ram front 214 and 216, respectively. The ram backs 210 and 212 are generally configured to receive a connector rod, such as the rod 34 shown in FIGS. 1A-1C, to move the shear ram assemblies 202 and 204 into and out of a BOP bore. As the ram assemblies 202 and 204 are for a shear ram BOP, the ram fronts 214 and 216 in this embodiment each include a cutting face or blade that is configured to shear an object located in a BOP bore.

The shear ram assemblies 202 and 204 may further include one or more seals or packer assemblies to facilitate sealing the BOP bore. For example, the ram assemblies 202 and 204 may each include a top seal 222 and 224 and side packer assemblies 226 and 228, respectively. The top seals 222 and 224 are positioned on the ram tops 230 and 232 of the ram bodies 206 and 208. The side packer assemblies 226 and 228 are then positioned on the ram sides 234 and 236 between the ram tops 230 and 232 and the ram bottoms of the ram bodies 206 and 208.

FIG. 2 only shows one side of the ram assemblies 202 and 204. However, a side packer assembly is also positioned on the opposite side of the ram assembly 202 with respect to the side packer assembly 226. Similarly, a side packer assembly is positioned on the opposite side of the ram assembly 204 with respect to the side packer assembly 228.

The seals 222 and 224 and side packer assemblies 226 and 228 are also positioned within cavities or channels formed within the ram bodies 206 and 208 to maintain the seals 222 and 224 and side packer assemblies 226 and 228 in position as the ram assemblies 202 and 204 move within the BOP housing. For example, the side packer assembly 226 may be positioned within a sider packer assembly cavity 270 formed on a side of the ram assembly 202, and the side packer assembly 228 may be positioned within a sider packer assembly cavity 272 formed on a side of the ram assembly 204.

Figure 3:
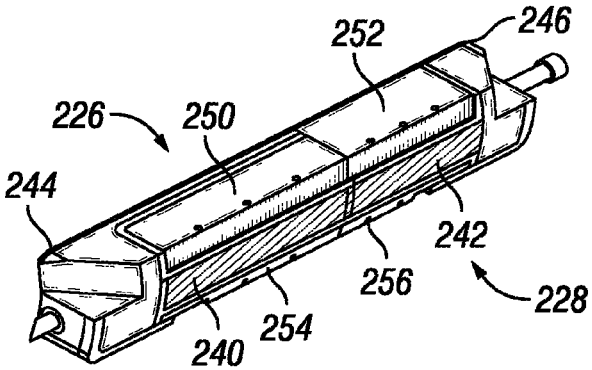
FIG. 3 depicts an above perspective view of side packer assemblies for ram assemblies, according to one or more embodiments.
Figure 4:
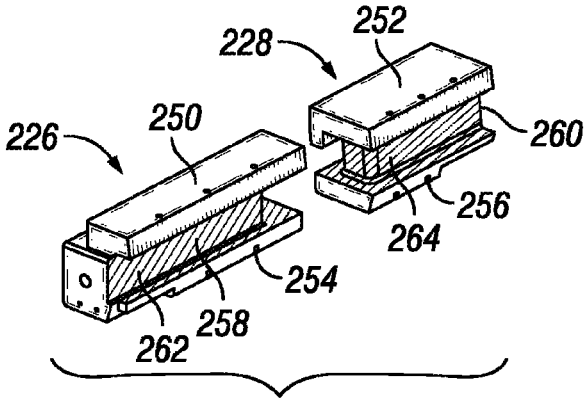
FIG. 4 depicts another above perspective view of side packer assemblies for ram assemblies, according to one or more embodiments.

Referring now to FIGS. 3 and 4, above perspective views of the side packer assemblies 226 and 228 in accordance with one or more embodiments of the present disclosure are shown. In particular, FIG. 3 shows the side packer assemblies 226 and 228 with each including elastomeric bodies 240 and 242 (i.e., elastomeric sealing elements) and attachment members 244 and 246, respectively. FIG. 3 shows the side packer assemblies 226 and 228 with the elastomeric bodies 240 and 242 and attachment members 244 and 246 removed.

The side packer assemblies 226 and 228 each include an upper plate 250 and 252 and a lower plate 254 and 256, respectively. The side packer assemblies 226 and 228 further include a support member 258 and 260, respectively, positioned between the upper and lower plates 250, 252, 254, and 256 and the elastomeric body 240 and 242 positioned between the upper and lower plates 250, 252, 254, and 256. The elastomeric bodies 240 and 242 may at least partially surround the support members 258 and 260 with the elastomeric bodies 240 and 242 contained between or in alignment with the profiles of the upper and lower plates 250, 252, 254, and 256. The elastomeric bodies 240 and 242 include or are formed from an elastomeric material, such as natural or synthetic rubber.

Referring still to FIGS. 3 and 4, the support members 258 and 260 and the elastomeric bodies 240 and 242 are shown as extending between the upper and lower plates 250, 252, 254, and 256250, 252, 254, and 256. In particular, the support members 258 and 260 are coupled or fixed to the upper and lower plates 250, 252, 254, and 256. For example, in one embodiment, the support members 258 and 260 and the respective upper and lower plates 250, 252, 254, and 256 may form an integral (e.g., single-piece) structure, such as to form a support structure for the elastomeric bodies 240 and 242. Further, the support members 258 and 260 may each have a front planar face 262 and 264, respectively, that extends between the respective upper and lower plates 250, 252, 254, and 256. In FIG. 3, the support members 258 and 260 are shown formed as support blocks that extend between the upper and lower plates 250, 252, 254, and 256.

As mentioned above, the side packer assemblies 226 and 228 include the attachment members 244 and 246. The attachment members 244 and 246 are used to removably couple the side packer assemblies 226 and 228 to the ram assemblies 202 and 204. This may enable the side packer assemblies 226 and 228 to periodically be removed and replaced as needed.

The attachment members 244 and 246 removably couple the side packer assemblies 226 and 228 to the top seals 222 and 224. Further, the attachment members 244 and 246 removably couple the support members 258 and 260 within the side packer assemblies 226 and 228. For example, the support members 258 and 260 may have an aperture formed in a side of the support members 258 and 260 (shown on the side of the support member 258 in FIG. 4). A connecting rod from the attachment members 244 and 246 may then be received within the aperture of each of the support members 258 and 260. This may facilitate replacement of the side packer assemblies 226 and 228, such as by only replacing the portion of the side packer assemblies 226 and 228 that includes elastomeric bodies 240 and 242.

In one or more embodiments, the support members 258 and 260 may be used to confine the movement of the elastomeric bodies 240 and 242 to a predetermined direction, such as when sealing within a BOP housing. In particular, the support members 258 and 260 may be used to prevent movement of the elastomeric bodies 240 and 242 in the axial (e.g., vertical) direction (with respect to a bore of a BOP housing) and confine the movement of the elastomeric bodies 240 and 242 to the lateral or radial (e.g., horizontal) direction (with respect to a bore of a BOP housing). The support members 258 and 260 may prevent relative movement between the upper and lower plates 250, 252, 254, and 256. This arrangement may confine movement of the elastomeric bodies 240 and 242 to the lateral or radial direction. Accordingly, this arrangement may prevent the elastomeric bodies 240 and 242 of the side packer assemblies 226 and 228 from urging the ram assemblies 202 and 204 axially apart from each other.

This arrangement may also facilitate forming a seal with the side packer assemblies 226 and 228 within the BOP housing and also against each other. For example, the ram assemblies 202 and 204 are movable within the BOP housing between an open position to enable fluid flow or an object to pass through the BOP bore, and a closed position to shear across or seal upon or about the BOP bore. When in the closed position, the side packer assemblies 226 and 228 may form a seal against each other, and/or the side packer assemblies 226 and 228 may form a seal within and against the ram cavities or bore of the BOP housing.

As discussed above a BOP in accordance with the present disclosure may include shear ram assemblies to shear one or more objects positioned within a BOP bore. Further, though not specifically shown, a BOP in accordance with the present disclosure may include pipe ram or variable bore ram assemblies for sealing about an object positioned within a BOP bore, or may include blind ram assemblies for sealing across a BOP bore when no object is present.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A ram assembly of a blowout preventer ("BOP") comprising:
- a ram body comprising:
  - a side cavity formed on a side of the ram body; and
  - a top cavity formed on a top of the ram body;
- a top seal is positionable within the top cavity;
- a side packer assembly positionable within the side cavity, the side packer assembly comprising:
  - an upper plate;
  - a lower plate;
  - an elastomeric body positioned between the upper plate and the lower plate and comprising elastomeric material;
  - a support member positioned between the upper plate and the lower plate and configured to confine movement of the elastomeric body; and
  - an attachment member configured to removably couple the side packer assembly to the top seal.

2. The ram assembly of claim 1, wherein the support member is configured to confine movement of the elastomeric body to the lateral direction when sealing within the BOP.

3. The ram assembly of claim 1, wherein the support member comprises a support block that is coupled to the upper plate and the lower plate.

4. The ram assembly of claim 1, wherein the ram assembly comprises a shear ram assembly.

5. A blowout preventer ("BOP"), comprising:
- a housing comprising:
  - a vertical bore extending through the housing; and
  - ram cavities intersecting the bore; and
- a pair of opposing ram assemblies, each ram assembly movably positionable within a ram cavity and comprising:
  - a side cavity formed on a side of the ram assembly with a side packer assembly positionable within the side cavity,
  - a top cavity formed on a top of the ram assembly with a top seal positionable within the top cavity;
  - the side packer assembly comprising:
    - an upper plate;
    - a lower plate;
    - an elastomeric body positioned between the upper plate and the lower plate and comprising elastomeric material;
    - a support member positioned between the upper plate and the lower plate and configured to confine movement of the elastomeric body when sealing; and an attachment member configured to removably couple the side packer assembly to the top seal.

6. The BOP of claim 5, wherein the support member is configured to confine movement of the elastomeric body to the lateral direction.

7. The BOP of claim 5, wherein each ram assembly comprises another side packer assembly with the side packer assemblies positioned on opposite sides of each ram assembly.

8. The BOP of claim 5, wherein the support member extends between the upper plate and the lower plate.

9. The BOP of claim 8, wherein the support member is coupled to the upper plate and the lower plate.

10. The BOP of claim 9, wherein the support member, the upper plate, and the lower plate comprise an integral support structure for the elastomeric body.

11. The BOP of claim 8, wherein the support member comprises a front planar face extending between the upper plate and the lower plate.

12. The BOP of claim 5, wherein the support member comprises a support block.

13. The BOP of claim 5, wherein the ram assemblies comprise shear ram assemblies configured to shear an object positioned within the bore of the housing.

14. The BOP of claim 5, wherein:

the ram assemblies are movable within the ram cavities between an open position and a closed position; and the side packer assemblies are configured to form a seal against each other and against the housing when the ram assemblies are in the closed position.

* * * * *